US006101669A

United States Patent [19]

Martin et al.

[11] Patent Number: 6,101,669

[45] Date of Patent: Aug. 15, 2000

[54] WET/DRY VACUUM

[75] Inventors: Michael F. Martin, St. Charles; Jeffrey L. Young, St. Peters, both of Mo.; John Moody, Bunker Hill; Joseph T. Gierer, Glen Carbon, both of Ill.; Kiyoshi Hoshino, Chesterfield, Mo.

[73] Assignee: Emerson Electric Co., St. Louis, Mo.

[21] Appl. No.: 09/090,609

[22] Filed: Jun. 4, 1998

[51] Int. Cl.[7] ..... A47L 5/36

[52] U.S. Cl. ..... 15/327.2; 15/327.6; 15/353

[58] Field of Search ..... 15/327.1, 327.2, 15/327.6

[56] References Cited

U.S. PATENT DOCUMENTS

| | | | |
|---|---|---|---|
| 1,316,442 | 9/1919 | Goughnour | 15/327.6 |
| 3,568,413 | 3/1971 | Jerabek | 15/327.6 X |
| 3,981,140 | 9/1976 | Lunsford et al. . | |
| 4,080,104 | 3/1978 | Brown | 15/353 X |
| 4,321,006 | 3/1982 | von Ohain et al. . | |
| 4,656,975 | 4/1987 | Johnson . | |
| 4,797,072 | 1/1989 | Berfield et al. . | |
| 4,864,680 | 9/1989 | Blase et al. | 15/353 X |
| 4,896,499 | 1/1990 | Rice . | |
| 5,076,758 | 12/1991 | Palgrave . | |
| 5,205,014 | 4/1993 | Yoo | 15/353 |
| 5,408,722 | 4/1995 | Berfield | 15/327.6 X |
| 5,535,500 | 7/1996 | Stephens et al. | 15/327.6 X |
| 5,560,075 | 10/1996 | Jankowski . | |
| 5,850,668 | 12/1998 | Berfield et al. | 15/353 |

OTHER PUBLICATIONS

Encyclopeadia Britannica, Inc.; The New Encyclopeadia Britannica; 1768, 15th Edition; 4 pages.

McGraw–Hill, Inc.; McGraw–Hill Encyclopedia of Science & Technology; 7th Edition; 5 pages.

*Primary Examiner*—Chris K. Moore

[57] ABSTRACT

A vacuum appliance is disclosed, comprising a collection canister and a powerhead housing a motor and impeller assembly for establishing vacuum pressure within said canister. In one embodiment, the appliance is of the wet/dry variety. A filter assembly comprising a rigid filter cage around which a filter is disposed. The filter cage is supported on an underside of the powerhead and extends into the collection canister such that the bottom of the filter assembly is at or substantially near the bottom of the collection canister. As a result, deflection of the collection canister as a result of vacuum pressure built up in the canister is resisted by the rigidity of the filter cage. In one embodiment, a frame within the powerhead serves the dual functions of supporting the motor and defining one wall or surface of an impeller chamber in which an impeller rotates to create the vacuum pressure. Barbed latches projecting from the powerhead function to removably secure the powerhead over the open top of the collection canister by engaging notches formed in the side of the canister. Substantially flat surfaces are formed in the vacuum's powerhead to facilitate the actuation of the latches, which is intuitively and ergonomically accomplished by a user resting his or her palm, thumb, or fingers on the substantially flat surfaces and grasping the latches with his or her free fingers.

6 Claims, 12 Drawing Sheets

WET/DRY VACUUM

FIELD OF THE INVENTION

This invention relates generally to the field of vacuum appliances, and more particularly relates to a vacuum adapted to pick up wet and dry materials.

BACKGROUND OF THE INVENTION

Vacuum appliances capable of picking up both wet and dry material, commonly referred to as wet/dry vacuums or wet/dry vacs, are well-known. Wet/dry vacs are often used in workshops and other environments where both wet and dry debris can accumulate.

Wet/dry vacs conventionally consist of a collection tank or canister, sometimes mounted on wheels or casters, and a cover or lid upon which a motor and impeller assembly is mounted. The motor and impeller assembly creates a suction within the canister, such that debris and liquid are drawn in to the canister through an air inlet to which a flexible hose can be attached. A filter within the canister prevents incoming debris from escaping from the canister while allowing filtered air to escape. One example of a such a wet/dry vac is shown in U.S. Pat. No. 4,797,072.

Wet/dry vacs are commercially available in a variety of sizes and configurations. The capacity, i.e., size, of a wet/dry vacuum collection canister, is typically measured in gallons. In many cases, the vacuum collection canister has a round or cylindrical configuration, since such a configuration represents the stablest pressure vessel, capable of withstanding the negative pressure (vacuum) forces that can be generated within a wet/dry vac.

While larger capacity wet/dry vacs tend to be more powerful and are able to pick up more debris before needing to be emptied, they also tend to be heavier and more awkward. Maneuvering a large, e.g., 12- to 16-gallon wet/dry vac in small or cluttered areas can be difficult. Additionally, since the motor of a wet/dry vac is typically disposed on top of the canister, wet/dry vacs tend to have a high center of gravity, making them prone to tipping over. This problem, recognized for example in U.S. Pat. No. 5,560,075 to Jankowski entitled "Wet or Dry Vacuum With Low Center of Gravity," tends to worsen as the capacity of the vac increases.

SUMMARY OF THE INVENTION

The present invention is directed to a vacuum appliance having numerous features believed to be advantageous. In one embodiment, the vacuum is of the wet/dry variety, and is of relatively small volume, on the order of two gallons or so.

In accordance with one aspect of the invention, the vacuum comprises a collection canister having a bottom, sides, and an open top. A powerhead is configured to be removeably secured over the open top of the collection canister. A rigid filter cage is supported underneath the powerhead and extends into the collection canister such that a bottom surface of the filter cage is at or substantially near the bottom of the collection canister. In this way, deflection of the canister as a result of vacuum pressure established in the vacuum is resisted by the rigid filter cage.

In accordance with another aspect of the invention, the vacuum's powerhead includes a frame which serves the dual purposes of supporting the motor and of defining at least one wall of an impeller chamber in which an impeller rotates to establish vacuum pressure in the vacuum. Accordingly, no gaskets are required for assembly of the powerhead.

In accordance with still another aspect of the invention, barbed latches are disposed on an underside of the powerhead, and project from the power head to engage notches formed in the side walls of the collection canister, thereby facilitating the removable securing of the powerhead to the canister. In one embodiment, the latches are molded as an integral part of the powerhead. The design of the latches is such that a moment is induced under load, causing the latches to hold more securely with increasing load.

BRIEF DESCRIPTION OF THE DRAWINGS

Various features and aspects of the present invention will perhaps be best understood with reference to a detailed description of a specific embodiment of the invention, when read in conjunction with the accompanying drawings, wherein.

DETAILED DESCRIPTION OF A SPECIFIC EMBODIMENT OF THE INVENTION

Figure 1:
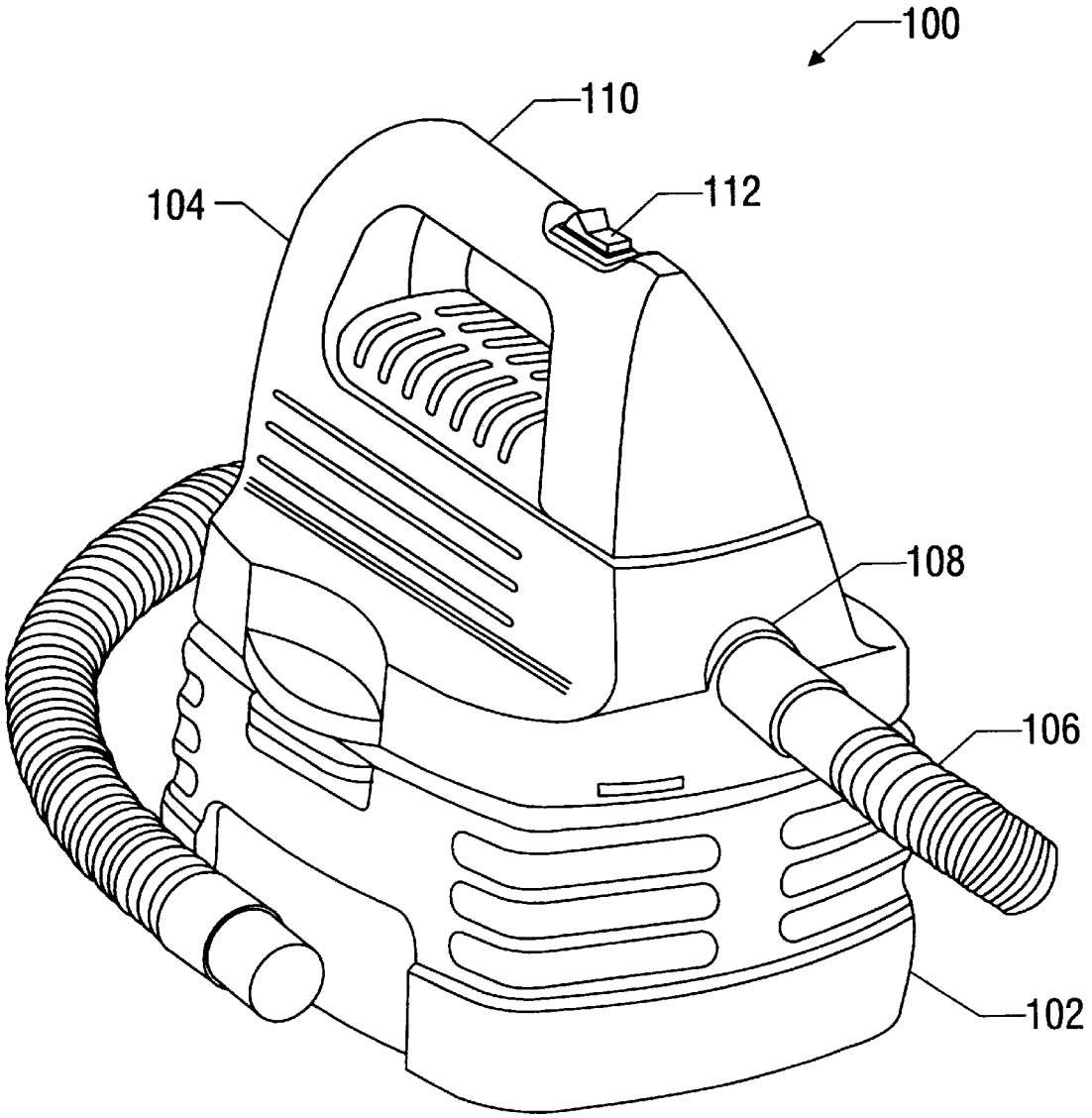
FIG. 1 is a perspective view of a wet/dry vacuum appliance in accordance with one embodiment of the invention.

Referring to FIG. 1, there is shown a perspective view of a vacuum appliance 100 in accordance with one embodiment of the invention. In the presently disclosed embodiment, vacuum 100 is of the wet/dry variety, i.e., capable of picking up both wet and dry material. Vacuum 100 is of relatively small capacity, having a collection canister volume of approximately two gallons (although it is understood that a vacuum in accordance with the present invention may be larger or smaller than two gallons).

Vacuum 100 comprises a collection canister 102 having a bottom, sides, and an open top, and having a powerhead 104 removably secured over the open top of collection canister. Powerhead 104 houses a motor and impeller assembly for establishing vacuum pressure within said vacuum 100. A flexible vacuum hose 106 is configured so that one end can be inserted into an air inlet 108 formed in the front portion of a powerhead 104. In one embodiment, hose 106 is simply friction-fitted into inlet port 108.

Figure 2:
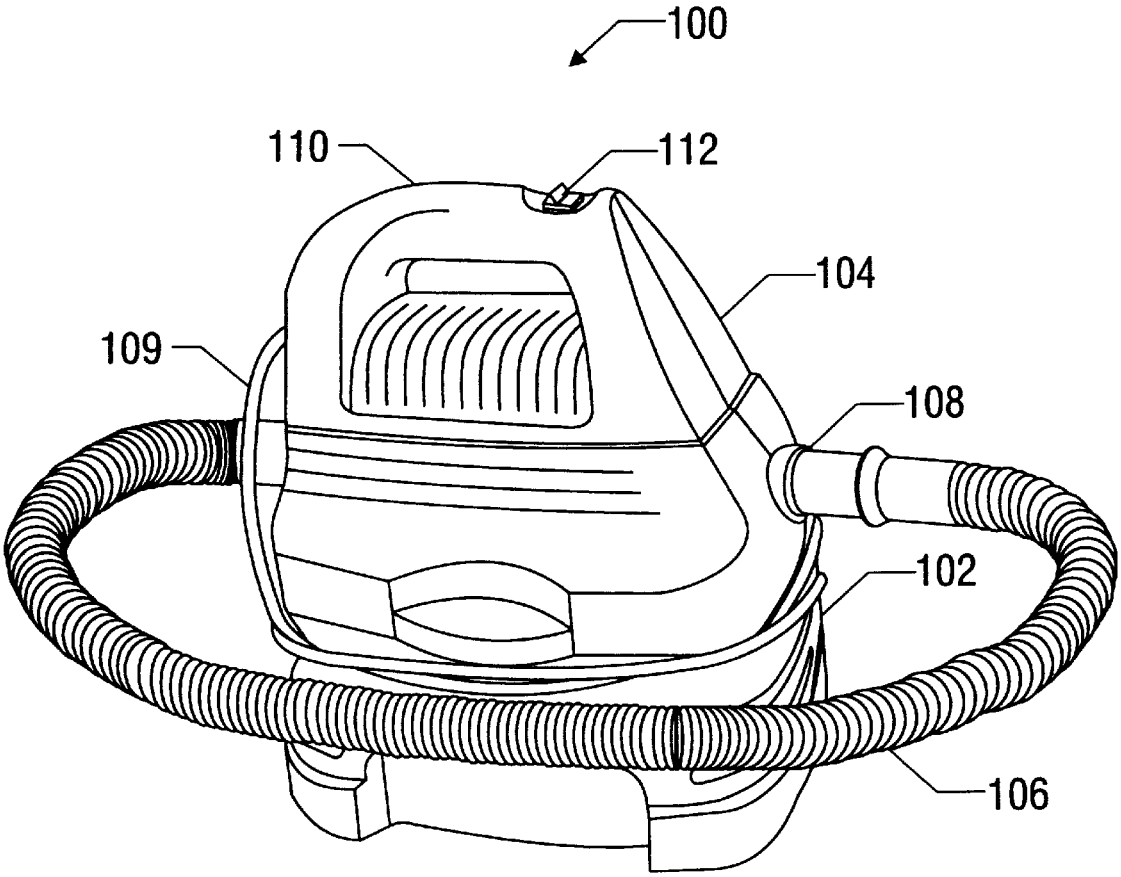
FIG. 2 is another perspective view of the vacuum from FIG. 1.

An air outlet port (not shown in FIG. 1) on the back of powerhead 104 is adapted to receive one end of hose 106 therein, so that, as depicted in FIG. 2, hose 106 may be attached at both ends to powerhead 104 during transport of vacuum 100. Typically, vacuum 100 would not be operated with both ends of hose 106 attached as shown in FIG. 2. However, due to its relatively small size, it is contemplated that vacuum 100 may also be utilized as a blowing appliance. In this mode of operation, one end of hose 106 is inserted into the air outlet port instead of air inlet port 108.

FIG. 2 also shows how electrical power cord 109 can be wrapped around vacuum 100, generally in the region of the interface between canister 102 and powerhead 104, during transport.

From FIGS. 1 and 2 it is apparent that an upper portion of powerhead 104 is configured to serve as a carrying handle 110 for vacuum 100. Toward the front of handle 110, an on/off switch 112 is disposed, such that switch 112 may be conveniently reached with one's thumb while holding vacuum 100 by handle 110.

Figure 3:
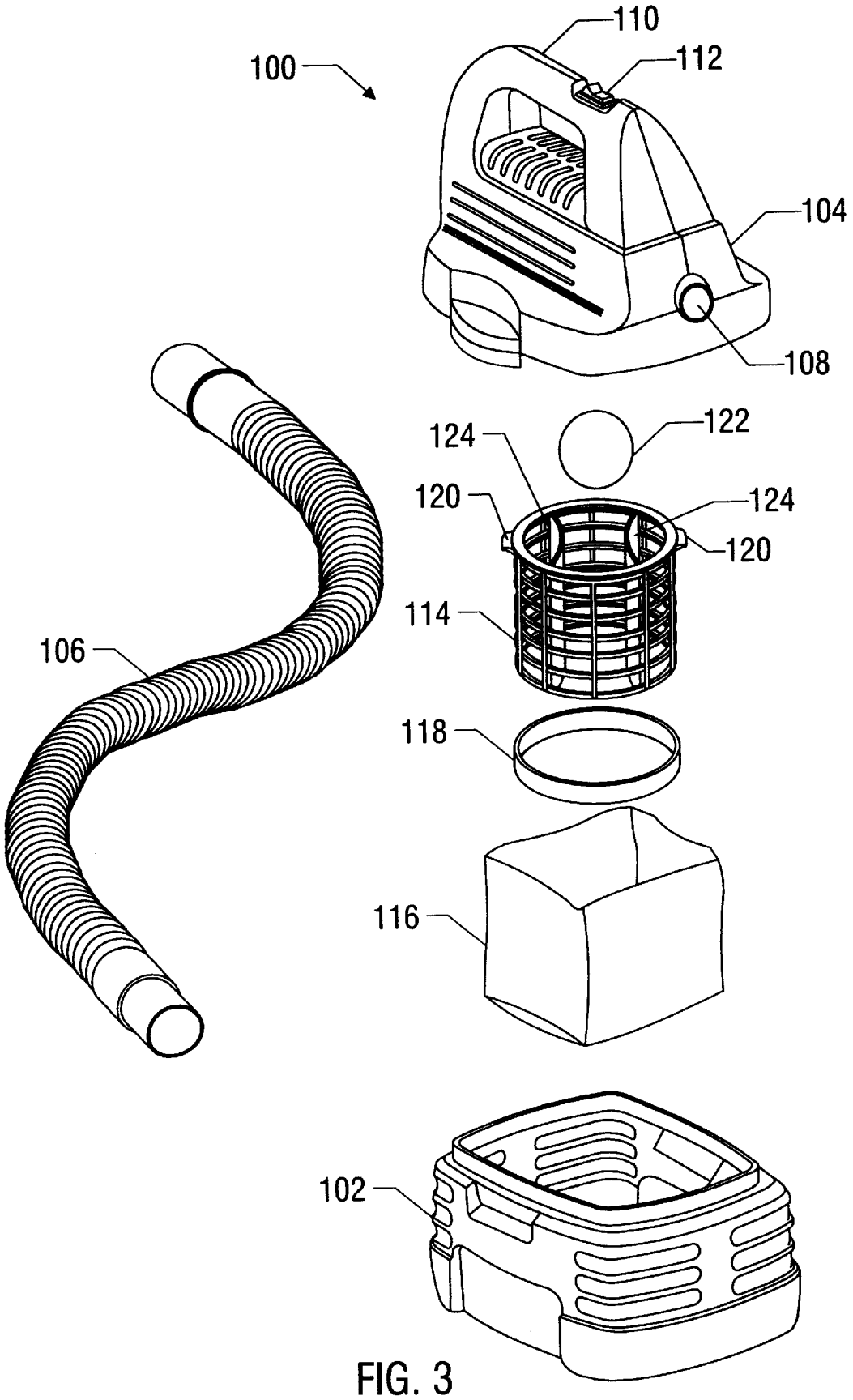
FIG. 3 is an exploded view of the vacuum from FIG. 1.

FIG. 3 is an exploded view of vacuum 100, showing certain internal components thereof not visible in the perspective views of FIGS. 1 and 2. As shown in FIG. 3, on the underside of powerhead 104 is a filter assembly comprising a rigid filter cage 114 and a bag-like filter 116. Filter cage 114 is adapted to be secured on the underside of powerhead 104. In the presently disclosed embodiment of the invention, filter cage 114 is made of polypropylene, although it is believed that other suitably rigid materials also may be used.

A bag-like filter 116 is sized to surround filter cage 114 and be secured thereon around an upper perimeter thereof by means of an elastic retaining band 118. A plurality of barb-like projections 120 around the upper perimeter of filter cage 114 function to engage retaining band 118, keeping band 118 and filter 116 from disengaging from cage 114.

As will be described herein in further detail, an air flow path is defined such that air is taken in through air inlet port, filtered through filter 116 (and cage 114), and finally expelled through the air outlet port 108, leaving vacuumed debris contained within collection canister 102, in accordance with the operation of conventional wet/dry vacs. The air is propelled through this air flow path by a motor and impeller assembly housed in powerhead 104. Although in the disclosed embodiment the air inlet port and air outlet port are defined by powerhead 104, it is contemplated that other embodiments may be implemented in which this is not the case. It is sufficient that the powerhead communicate with the air inlet port and the air outlet port during operation, such that powerhead 104 can perform the function of causing air to be drawn in through the air inlet port and expelled out through the air outlet port.

Figure 4:
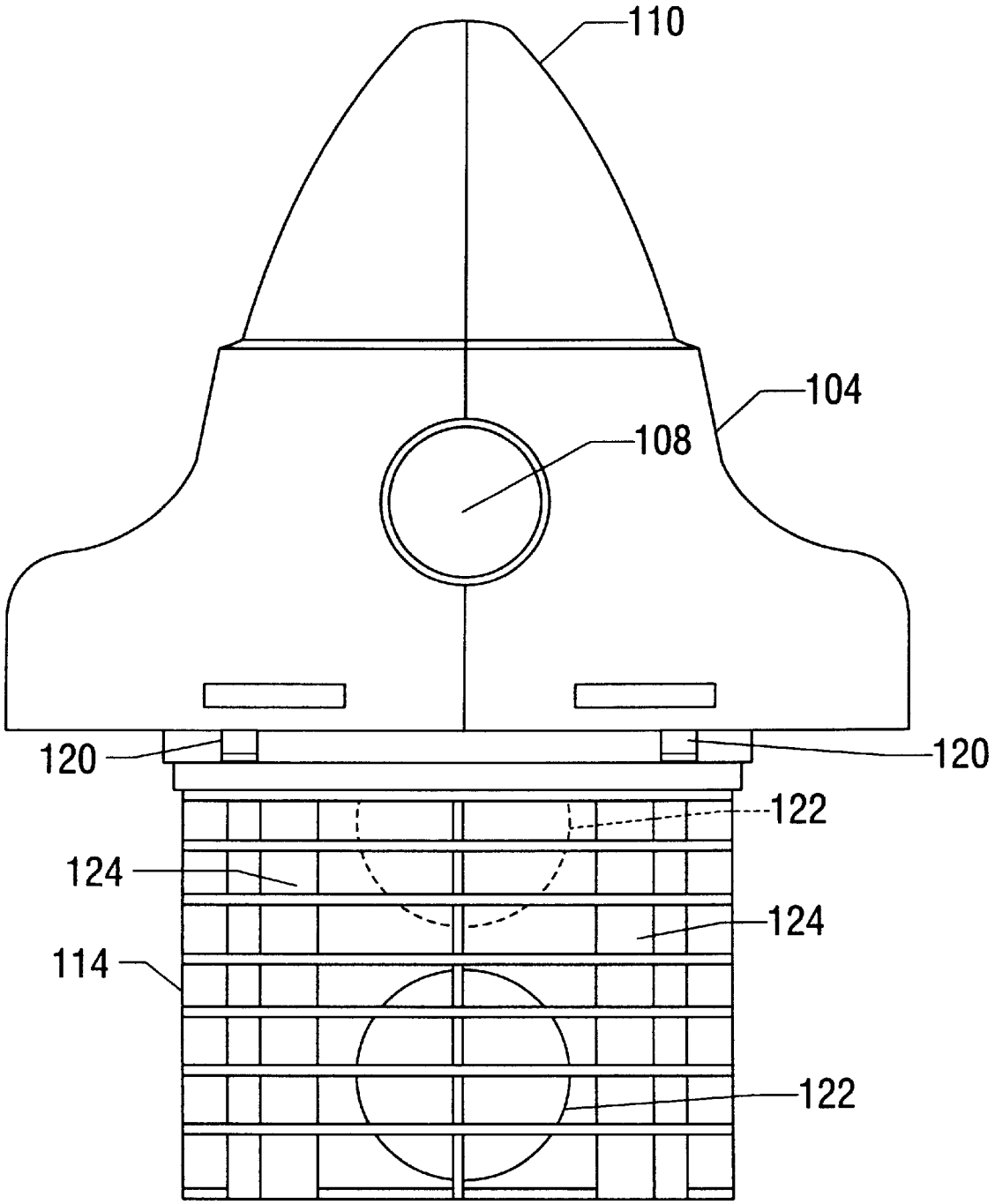
FIG. 4 is a front view of the powerhead and filter cage assembly from the vacuum of FIG. 1.

A float ball 122 is disposed within filter cage 114. Float ball 122 rises automatically within cage 114 to cut off the flow of air through vacuum 100 when liquid in canister 102 reaches a predetermined level. A plurality of fins 124 are formed within cage 114 to serve as guides to keep float ball 122 centrally disposed within cage 114. This can be better observed in the front view of FIG. 4, which shows float ball in its raised position in phantom.

Figure 5:
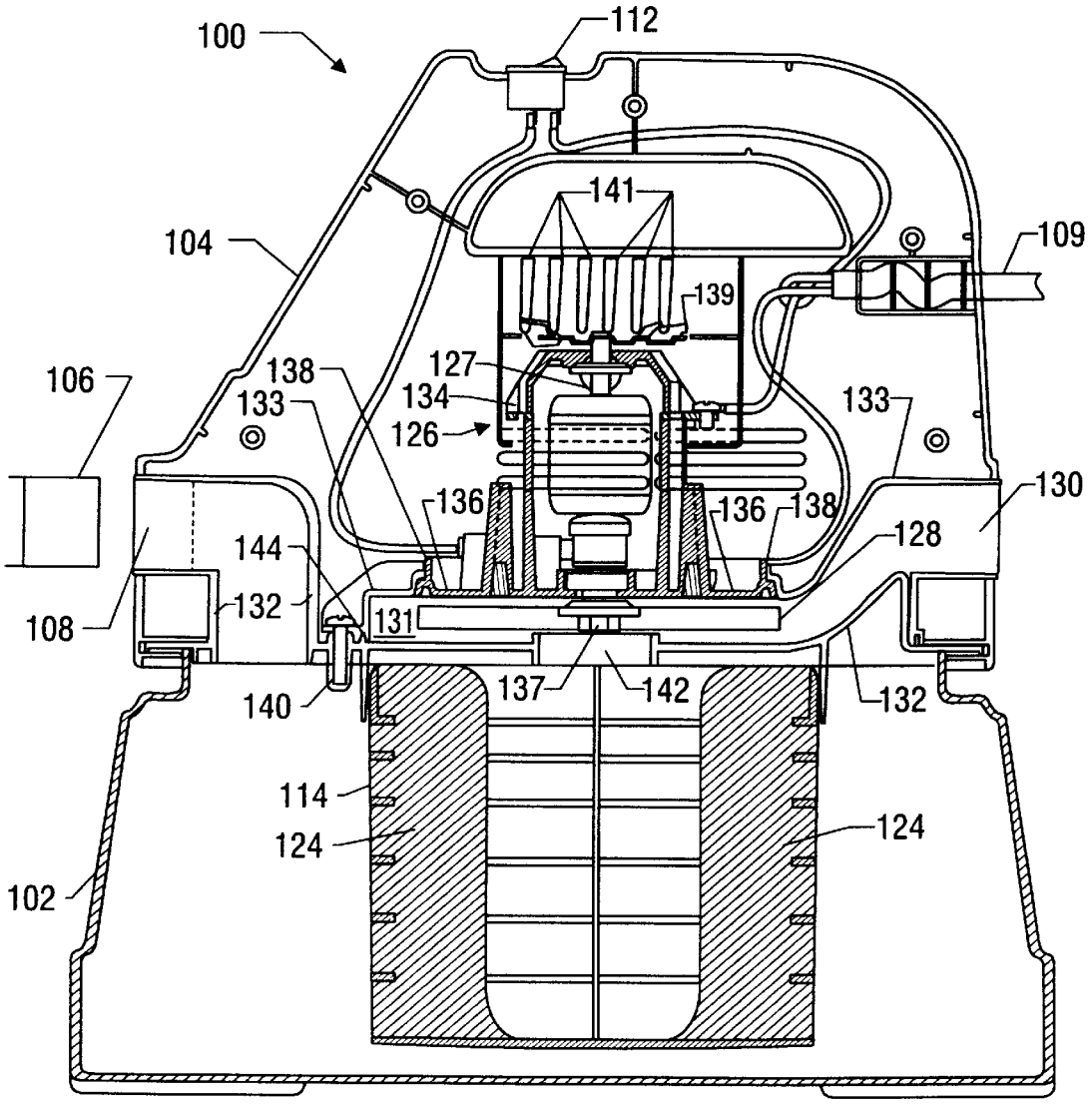
FIG. 5 is a side cross-sectional view of the vacuum of FIG. 1.

FIG. 5 is a cross-sectional side view of vacuum 100. In the cross-sectional view of FIG. 5, it can be seen that powerhead 104 houses a motor 126 which receives electrical power from power cord 109 via switch 112. Motor 126 functions to turn an impeller 128 disposed generally above filter cage 114, such that air is drawn into air input port 108, through filter 116 (not shown in FIG. 5) and cage 114, and out an air outlet port 130.

As noted above, considerable negative pressure or vacuum forces can be generated within wet/dry vacuums. One ramification of this is that canister 102 must be sufficiently rigid so as to minimize any deflection and/or possible collapsing under the vacuum forces that may be generated therein during operation of vacuum 100. For vacuum 100, this issue is particularly critical, since canister 102 is not round, and thus is not an ideal or near-ideal pressure vessel, as would be appreciated by those of ordinary skill in the art.

One manner of reducing or eliminating the amount of deflection of canister 102 and hence reducing or eliminating the possibility of the collapsing thereof is to make the walls of canister 102 sufficiently thick. However, this tends to undesirably add to the weight and cost of manufacture of vacuum 100. Thus, in accordance with one aspect of the present invention, rigid filter cage 114 is configured so as to contribute to the structural stability and strength of vacuum 100. As is apparent especially from FIG. 5, when powerhead 104 is fastened upon canister 102, filter cage 114 extends substantially to the bottom of canister 102, such that the bottom of filter cage 114 is disposed on, or at least substantially directly above, the bottom of canister 102.

By locating the bottom of filter cage 114 in such close proximity to the bottom of canister 102, the amount of inward deflection of the bottom of canister 102 resulting from high vacuum pressure generated within canister 102 is limited by the bottom of canister 102 contacting the bottom of filter cage 114. Once contact is made between the bottom of canister 102 and the bottom of filter cage 114, the system enters an equilibrium condition where both powerhead 104 and the bottom of canister 102 compress against filter cage 114. In this way, filter cage 114 acts as a central support pillar for high vacuum situations.

Since canister 102 is preferably made of blow-molded plastic, such as polyethylene or the like, the support provided by filter cage 114 under high vacuum conditions is also advantageous in elevated temperatures, where the elastic modulus of the plastic material of canister 102 is reduced and canister 102 would be even more vulnerable to collapse. Once contact between filter cage 114 and canister 102 is made, the forces are transferred to the filter cage as a compressive load.

Filter cage 114 is especially well-suited to provide added structural support to canister 102 as a result of the presence of vertical ribs 124, which gives filter cage 114 substantial vertical strength.

Figure 6:
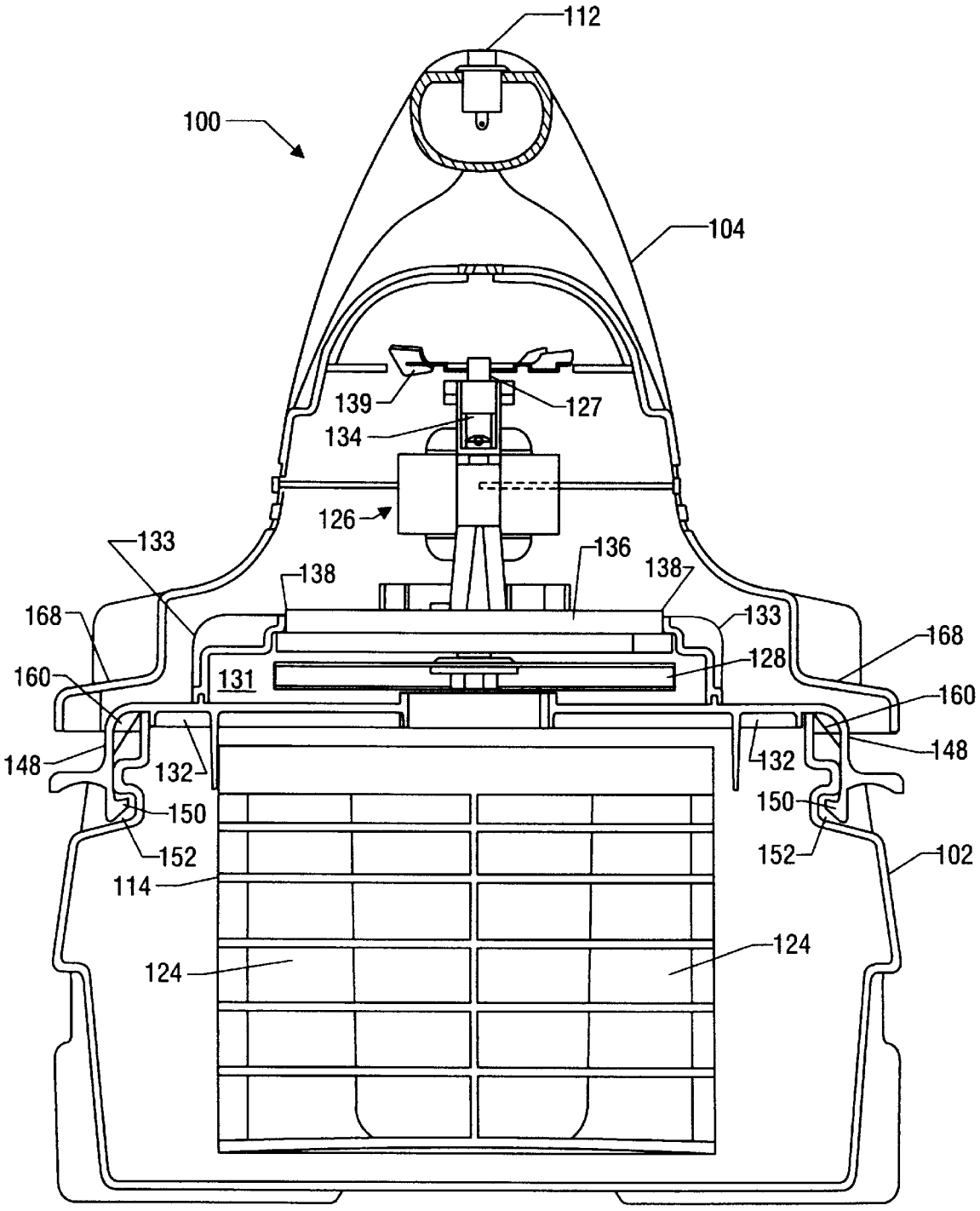
FIG. 6 is a front cross-sectional view of the vacuum of FIG. 1.
Figure 7:
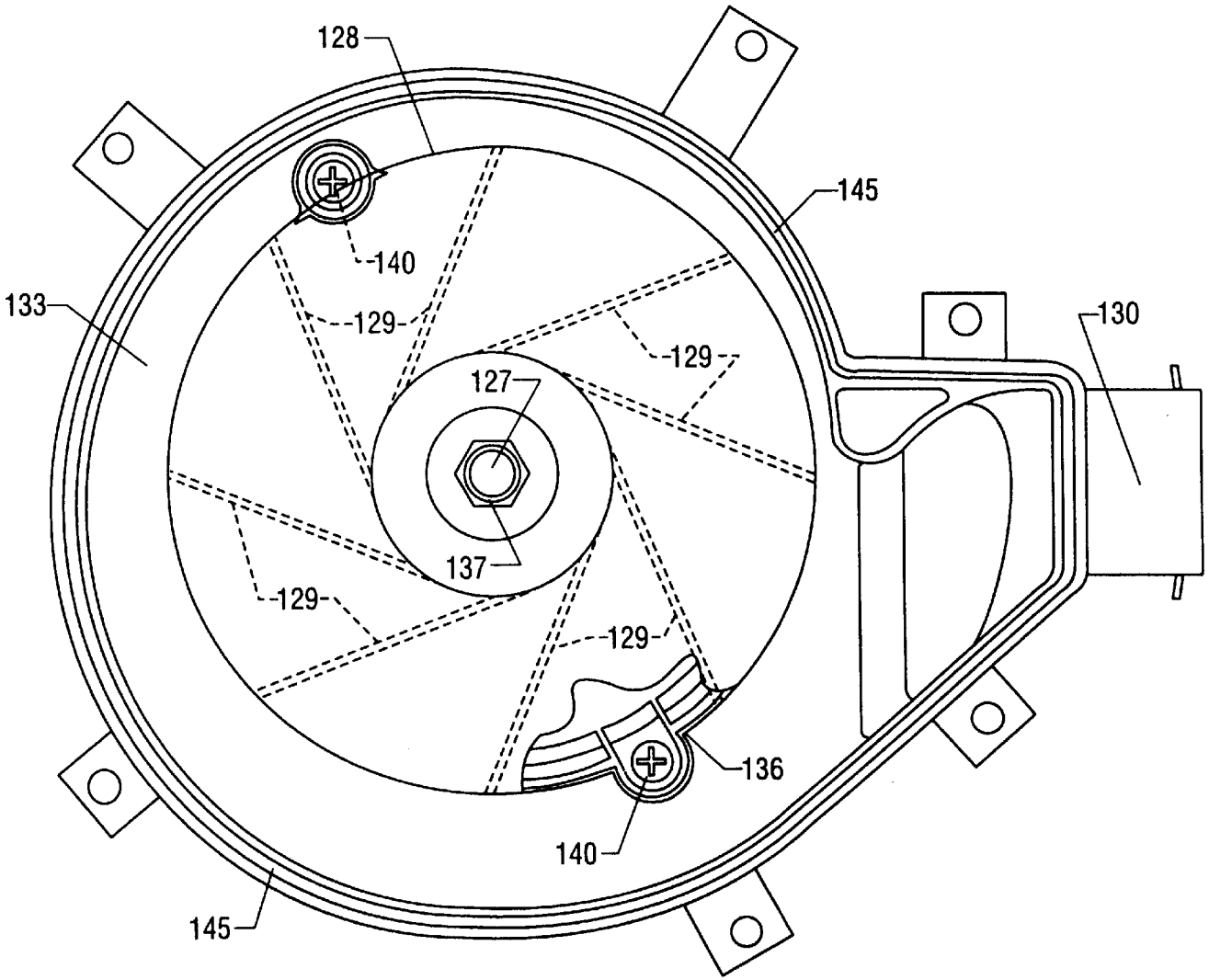
FIG. 7 is a bottom view of a motor and impeller assemblies in the vacuum of FIG. 1.

With continued reference to FIG. 5, and also with reference to the cross-sectional end view of FIG. 6, it can be seen that motor 126 is an assembly that includes an upper motor frame 134 and a lower motor frame 136. It can be further be seen in FIGS. 5 and 6 that impeller 128 is disposed within a collector chamber 131 having a bottom surface substantially defined by a bottom 132 of powerhead 104, and having a top surface defined partially by a collector member 133 and partially by lower motor frame 136. Impeller 128 includes a plurality of fins or blades 129 (shown in phantom in FIG. 7) for propelling air when impeller 128 rotates.

In the presently disclosed embodiment, collector chamber 131 preferably has an involute configuration, to maximize performance of vacuum 100. Such an involute configuration can be observed in FIG. 7, which shows the bottom of impeller 128, collector member 133, and lower motor frame 136. From FIGS. 5 and 7 it can be seen that collector member 133 also defines air outlet port 130. From FIGS. 5 and 6, it can be seen how impeller 128 is disposed on one end of an armature shaft 127 of motor 126 extending through lower motor frame 136. In one embodiment, the impeller end of shaft 127 extending through lower motor frame 136 is threaded, such that impeller 128 is secured on the end of shaft 127 with a nut 137. Also, on the end of shaft opposite impeller 128, a fan 139 may be disposed, to cool motor 126 during operation thereof. Air vents 141 may be formed in powerhead 104 to facilitate the cooling of motor 126 by fan 139.

As will be appreciated by those of ordinary skill in the art, collector chamber 131 surrounds impeller 128, and its configuration is such that the rotation of fins or blades 129 of impeller 128 causes the vacuum pressure to be created within vacuum 100. Such fundamental principles of operation of vacuum appliances generally are very well-known in the art, and will not be elaborated upon further herein.

As those of ordinary skill in the art will appreciate, given the involute configuration of collector chamber 131, it is preferable that the area behind (i.e., above) impeller 128 be substantially flat. Such a large, flat area, however, can be difficult to make rigid enough to resist the high vacuum forces which can be generated within vacuum 100. This is especially true if the materials which define chamber 131 are low-modulus commodity plastics, which in some embodiments may be preferable. Thus, in accordance with one aspect of the present invention, motor frame 136 has a substantially flat and circular base molded of high-modulus thermoplastic, where this base of lower motor frame 136 serves not only as a functional element of motor 126, but also, as part of the collector assembly and hence partially defining chamber 131, to impart rigidity and strength to collector chamber 131.

In the presently disclosed embodiment of the invention, lower motor frame 136 is press-fit into a circular aperture in collector member 133, creating an annular seal designated with reference numerals 138 in FIGS. 5 and 6. Advantageously, no gaskets or the like are required to form seal 138; that is, seal 138 is "gasketless." The assembly consisting of motor 126, collector member 133, and motor frames 134 and 136 is attached to bottom 132 of powerhead 104 with screws 140. An intake aperture 142 defined by powerhead bottom 132 provides a path for the flow of air to impeller 128 to be expelled through output port 130.

Collector member 133 is preferably made of polypropylene, which is relatively lightweight and inexpensive. The configuration of collector member 133 as just described takes advantage of the flex modulus of polypropylene to create a seal between collector member 136 and the relatively more rigid lower motor frame 136, which is preferably made of glass-filled polyester, glass-filled polycarbonate, thermoset polyester, or the like, which are more rigid than polypropylene, but which can be heavier and more expensive. When vacuum 100 experiences sealed suction conditions, the stiffness of lower motor frame 136 minimizes flexing of the walls of collector chamber 131 and counters the forces created by the moment induced around the perimeter of collector member 133.

To form a seal between collector member 133 and powerhead bottom 132, an annular ring seal 144 is formed in bottom 132, which interlocks with a corresponding annular groove 145 (see FIG. 7) in collector member 133, in a tongue-and-groove fashion. The collector chamber configuration as described herein thus is gasketless, makes optimum use of lighter and less expensive materials, while still maintaining structural integrity.

Figure 8:
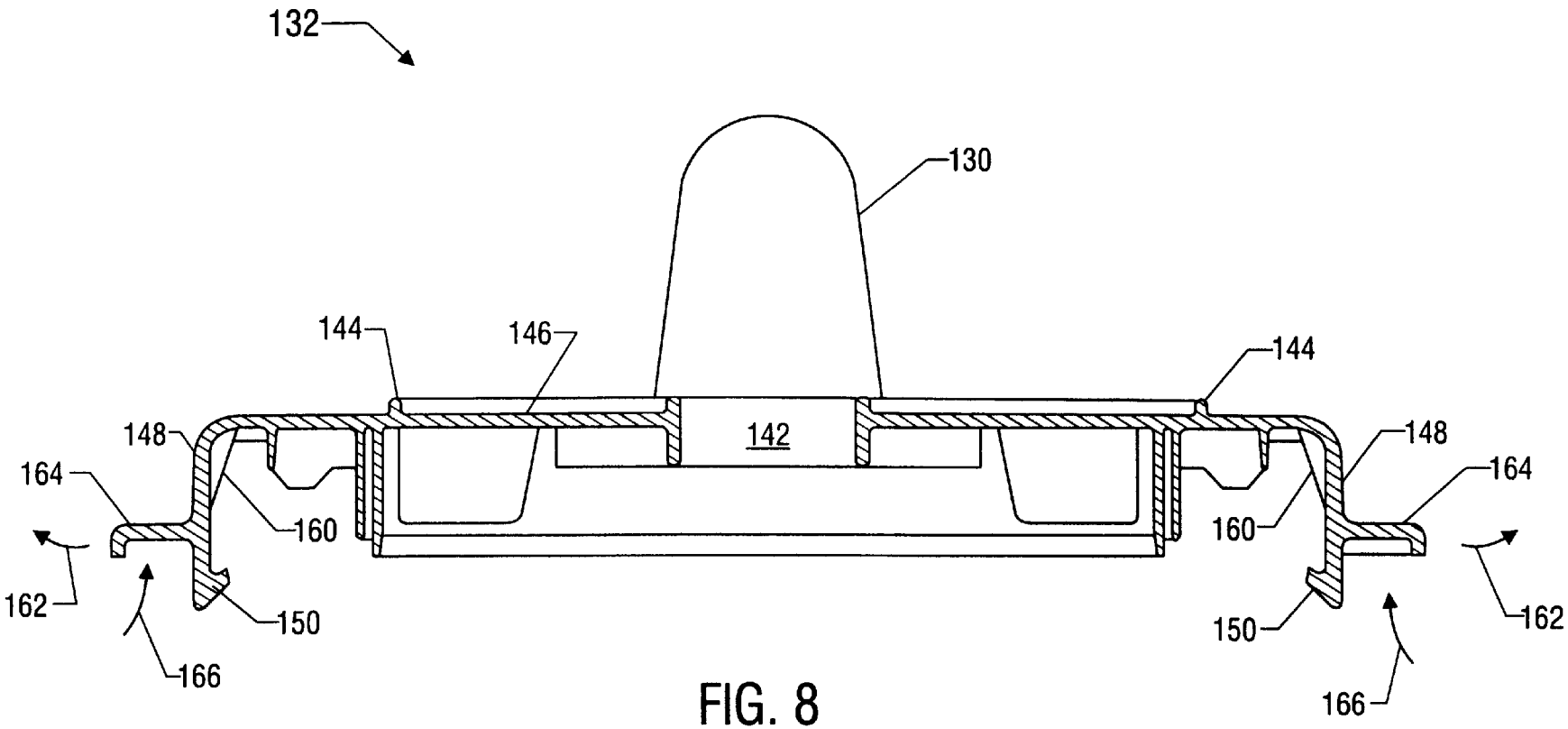
FIG. 8 is a front cross-sectional view of a bottom portion of the powerhead in the vacuum of FIG. 1.
Figure 9:
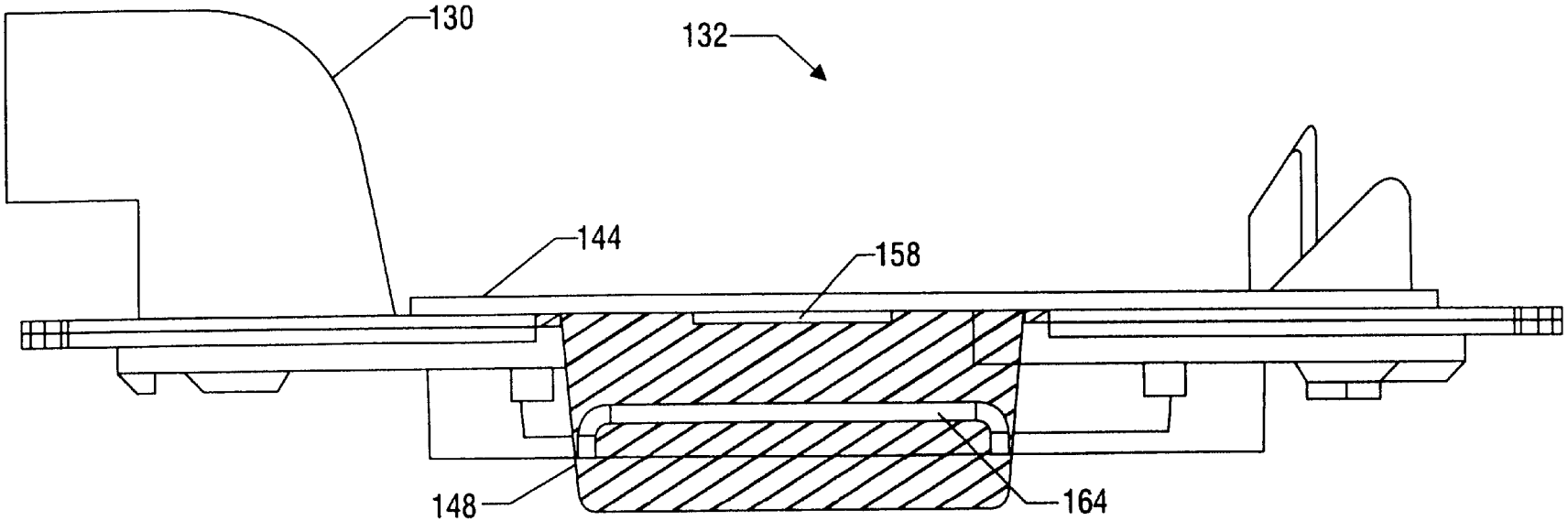
FIG. 9 is a side view of the bottom portion of the powerhead in the vacuum of FIG. 1.
Figure 10:
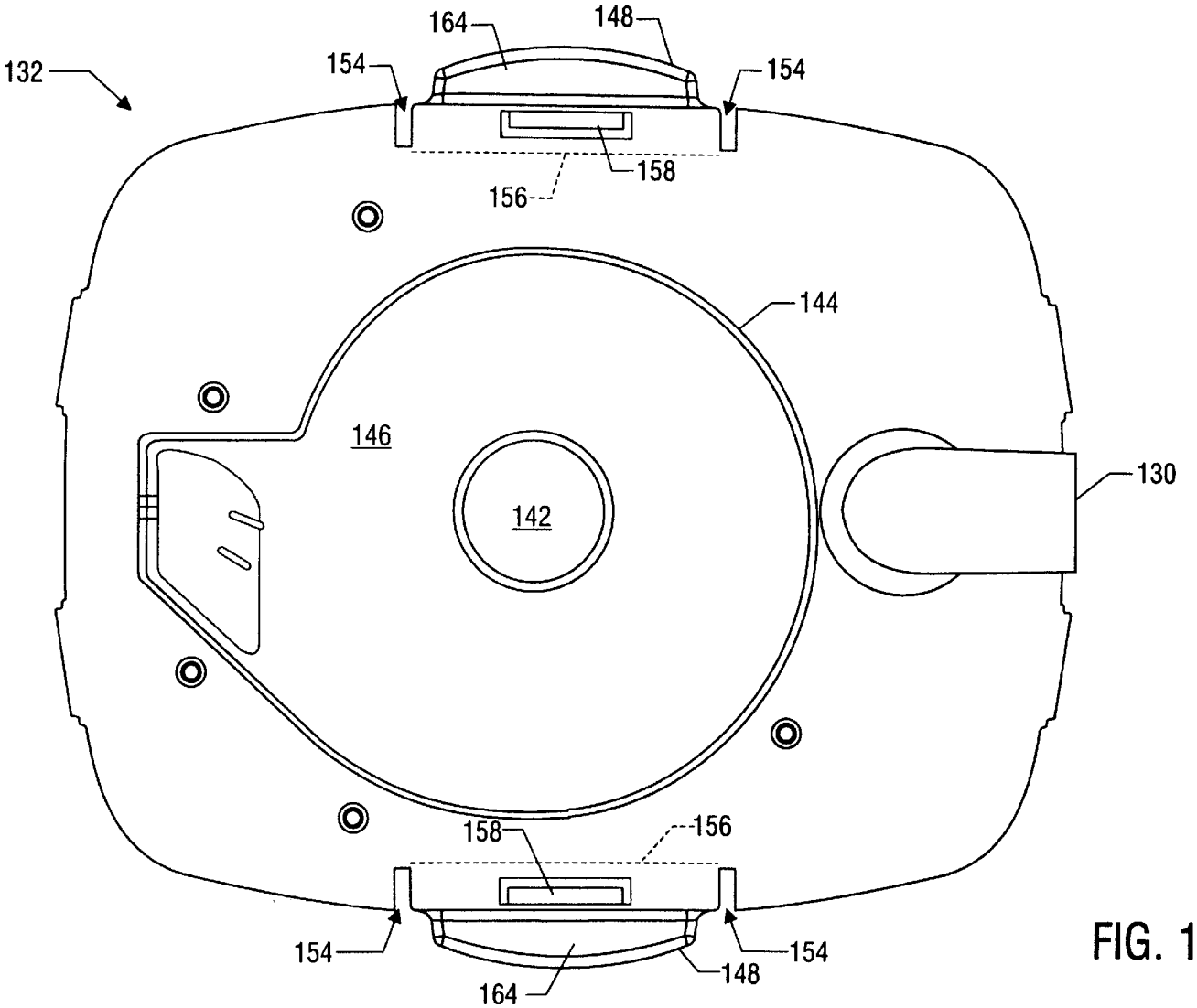
FIG. 10 is a top view of the bottom portion of the powerhead in the vacuum of FIG. 1.

FIGS. 8, 9, and 10 are end, side, and top views, respectively of powerhead bottom 132 in accordance with the presently disclosed embodiment of the invention. Powerhead bottom 132 is preferably made of polypropylene or a similar material. As previously described, powerhead bottom 132 mates with collector member 133 and to this end is provided with an annular sealing ring 144. Additionally, collector member 133 defines air outlet port 130. Aperture 142 provides a passage for the flow of air from filter cage 114 into impeller chamber 131. As previously discussed, an upper surface 146 of powerhead bottom 132 defines a substantially flat lower surface of involute impeller chamber 131.

In accordance with one aspect of the presently disclosed embodiment of the invention, powerhead bottom 132 is configured so as to be capable of securing powerhead 104 to canister 102. To this end, a latching interface comprising two latches 148 is provided. In the presently preferred embodiment of the invention, latches 148 are integrally molded or formed as part of powerhead bottom 132.

Figure 11:
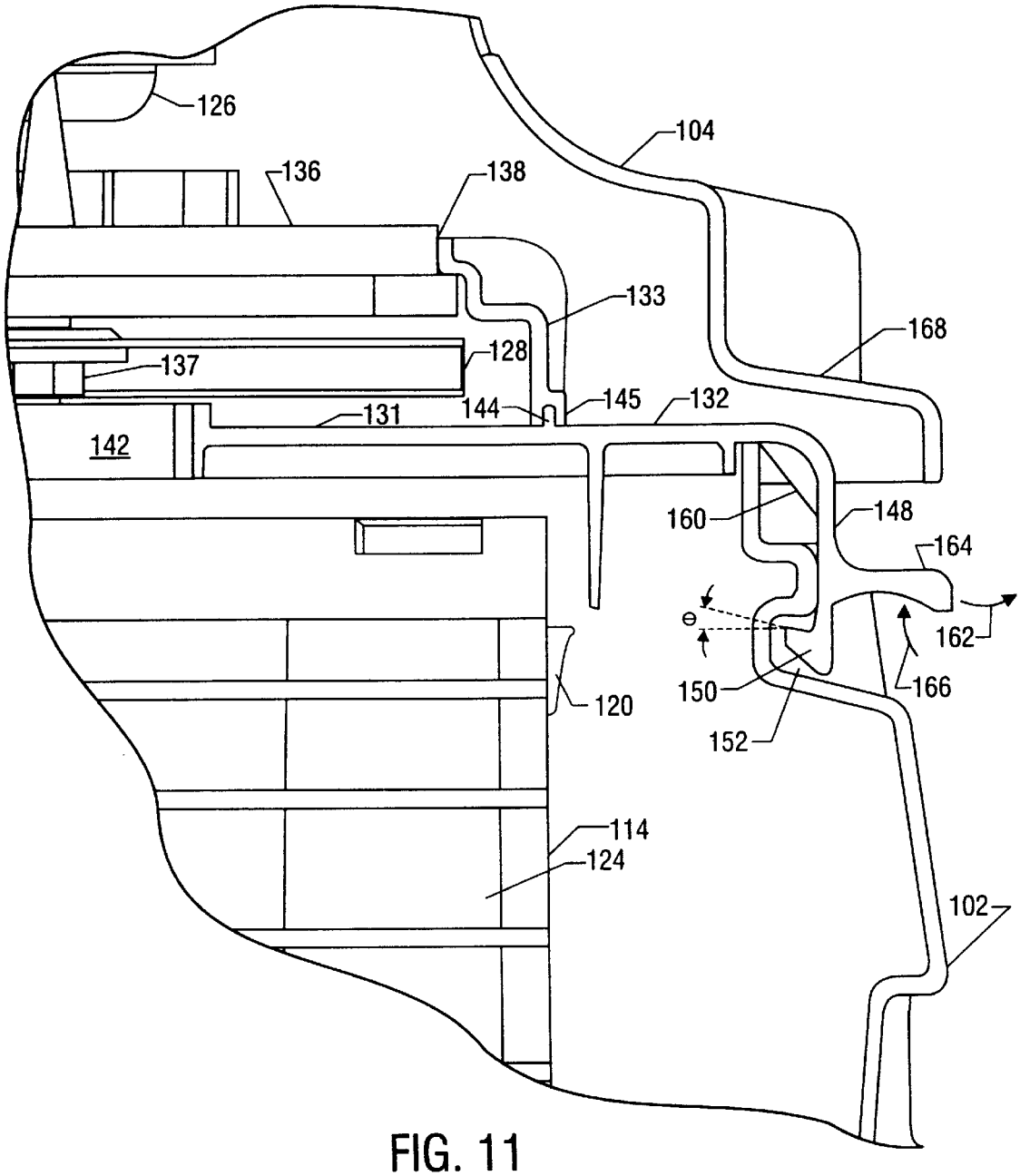
FIG. 11 is a partial cross sectional view of the powerhead, canister, and motor and impeller assembly in the vacuum of FIG. 1.

The manner in which latches 148 engage canister 102, thereby securing powerhead 104 thereto, can be best appreciated with reference to FIG. 6, and with reference to the enlarged partial view of FIG. 11. (FIG. 11 also shows with clarity a number of elements and features of vacuum previously discussed with reference to FIGS. 1–10, including, for example, filter retaining band barbs 120, annular sealing ring 144 and mating groove 145, and the annular seal 138 lower motor frame 136 and collector 131.)

With continued reference to FIGS. 8, 9, 10, and 11, each latch 148, being integral with powerhead bottom 132, projects substantially perpendicularly downward from the bottom 132 of powerhead 104. Each latch 148 has a barb 150 at the distal end thereof, enabling each latch 148 to become engaged within a recess 152 formed in the side wall of canister 102. Barbs 150 are tapered such that powerhead 104 may be secured to canister 102 by simply pushing powerhead 104 downward onto canister 102. With this downward pushing and the taper of barbs 150, latches 148 are automatically forced outward.

The flexibility of the material from which powerhead bottom 132 is made allows latches 148 to flex outward sufficiently that barbs 150 become engaged in recesses 152. This flexibility may be further enhanced by providing notches 154 in powerhead bottom 132 on either side of latches 148 (see FIG. 10 in particular), such that latches flex with respect to the rest of powerhead bottom 132 generally along the line designated with dashed lines 156 in FIG. 10.

The flexibility of latches 148 along lines 156, represented by arrows 162 in FIGS. 8 and 11, may be further enhanced by providing cut-outs 158 at the bases of latches 148, as is also shown in FIG. 10. Finally, since latches 148 are preferably integral with powerhead bottom 132, the flexibility may advantageously be limited to the regions of lines 156 by providing ribs or gussets 160 just behind each latch, as is best shown in FIG. 8. Gussets 160 direct the pivot point 156 inboard, inducing a latching moment such that powerhead 104 remains secured to canister when vacuum 100 is picked up by handle 110 and the load of canister 102 is carried by latches 148. That is, gussets 160 cause latches 148 to flex at points offset from the respective latching barbs 150; under a load, this advantageously induces a moment which serves to hold canister 102 even more securely when filled with liquids or debris, rather than less securely. That is, latches 148 are configured such that when a load is applied against latchs 148, the load is converted to a force couple system tending to enhance engagement between canister 102 and latches 148.

To further ensure that latches 148 remain engaged within notches 152, the upper edge of barbs 150, and the upper surfaces of notches 152 are negatively angled, as represented by the angle $\phi$ in FIG. 11.

To facilitate removal of powerhead 104 from canister 102, latches 148 are provided with handles 164 which, when lifted or pressed upward in the direction of arrows 166 in FIGS. 8 and 11, cause latches 148 to flex outward in the direction of arrows 162, enabling barbs 150 to be released from recesses 152 and powerhead 104 to be removed from canister 102.

Figure 12:
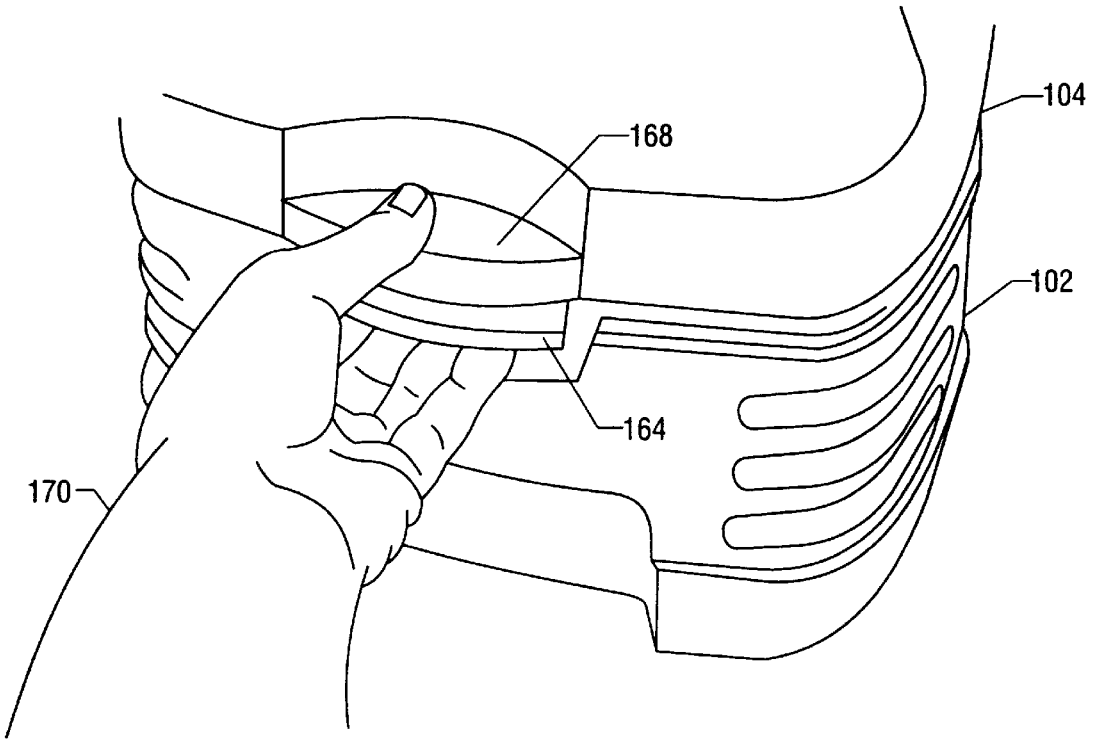
FIG. 12 is a perspective view illustrating detachment of the powerhead from the canister with the vacuum of FIG. 1.

To further facilitate the removal of powerhead 104 from canister 102, substantially flat stationary surfaces 168 are defined in powerhead 104, as shown in FIGS. 6 and 11, just above each latch handle 164, As shown in FIG. 12, the presence of a stationary surface 168 above each latch handle 164 facilitates the gripping and squeezing of handles 164. The user 170 may place his or her palm, thumb, or fingers on stationary surface 168, and latch handles 164 are readily within the grasp of the free digits of the hand.

The latching interface just described with reference to FIGS. 8–12 is believed to be highly convenient from an ergonomic standpoint, and makes the mounting and removal of powerhead 104 easy and intuitive.

From the foregoing detailed description of a specific embodiment of the invention, it should be apparent that a wet/dry vacuum appliance has been disclosed. Although a specific embodiment of the invention has been described herein in some detail, it is to be understood that this has been done solely for the purposes of illustrating various aspects and features of the invention, and is not intended to be limiting with respect to the scope of the claims. It is contemplated that various substitutions, alterations, and/or modifications, including but not limited to those design alternatives that may have been specifically noted herein, may be made to the disclosed embodiment without departing from the spirit and scope of the invention, as defined in the appended claims, which follow.

What is claimed is:

1. A vacuum appliance, comprising:

a collection canister having a bottom, sides, and an open top;

a powerhead, adapted to be removably secured to said collection canister, said powerhead having an air inlet port and an air outlet port formed therein;

a filter assembly, coupled to said powerhead such that when said powerhead is secured to said collection canister, said filter assembly extends from beneath said powerhead to substantially near said bottom of said collection canister;

wherein said powerhead houses a motor and impeller assembly for establishing vacuum pressure within said canister, such that air is drawn in said air inlet port, through said filter assembly and said impeller assembly, and expelled out of said air outlet port;

and wherein said motor and impeller assembly comprises a motor, an impeller coupled to and rotated by said motor, and a motor frame;

and wherein said filter assembly is adapted to resist deflection of at least said bottom of said canister when vacuum pressure is established in said canister.

2. A vacuum appliance in accordance with claim 1, wherein said collection canister has a capacity of approximately two gallons.

3. A vacuum appliance in accordance with claim 1, further comprising a collector chamber, wherein said collector chamber has an aperture therein adapted to receive a portion of said motor frame and cooperating therewith to define an upper surface of said collector chamber.

4. A vacuum appliance in accordance with claim 3, wherein said portion of said motor frame is press-fit into said aperture to define a gasketless annular seal between said collector chamber and said motor frame.

5. A vacuum appliance in accordance with claim 3 wherein said powerhead has a bottom configured to engage said collector chamber in a tongue-in-groove configuration thereby forming a gasketless seal therebetween.

6. A vacuum appliance in accordance with claim 5, wherein said collector chamber and said powerhead bottom are made of polypropylene.

* * * * *